United States Patent [19]

Horimoto

[11] Patent Number: 4,620,554

[45] Date of Patent: Nov. 4, 1986

[54] MODERATING AGENT OF CIGARETTE TASTE

[75] Inventor: Yoshimitsu Horimoto, Osaka, Japan

[73] Assignee: Luxeord Co., Ltd., Osaka, Japan

[21] Appl. No.: 634,427

[22] Filed: Jul. 26, 1984

[51] Int. Cl.[4] ..... A24F 47/00

[52] U.S. Cl. ..... 131/270; 131/331; 131/335; 131/359; 131/369

[58] Field of Search ..... 131/270, 331, 335, 359, 131/369

[56] References Cited

U.S. PATENT DOCUMENTS 3,965,911 6/1976 Anderson et al. ..... 131/359
4,284,089 8/1981 Ray ..... 131/270

FOREIGN PATENT DOCUMENTS 46-6839 2/1971 Japan ..... 131/331
57-159480 10/1982 Japan ..... 131/275
0929529 6/1963 United Kingdom ..... 131/270

*Primary Examiner*—William R. Dixon, Jr.
*Assistant Examiner*—Margaret B. Medley
*Attorney, Agent, or Firm*—Birch, Stewart, Kolasch & Birch

[57] ABSTRACT

A moderating agent of the cigarette taste, attached to the top end of the cigarette, capable not only of promoting the cigarette flavorous taste but also by reducing the cigarette hazardous taste caused by nicotine when the cigarette is lighted and smoked. The moderating agent of the cigarette taste is a powder material formed by compounding ascorbic acid, or its isomer, or the salts thereof, a powder capsule of vegetable oils and fats, a powder of dried comfrey leaves, at least one substance selected from wheat protein and soybean protein, and at least over one kind of substance selected from beefsteak plant, Japanese mint, peppermint and vanilla.

2 Claims, No Drawings

MODERATING AGENT OF CIGARETTE TASTE

BACKGROUND OF THE INVENTION

The present invention relates to an improvement in the moderating agent of the cigarette taste, attached to the top end for cigarette, which is capable not only of promoting the flavor of cigarette taste but also when it the hazardous cigarette taste caused by a nicotine, when it is lighted and smoked.

The applicant, who has manufactured and marketed moderating agents for cigarette taste formed by compounding ascorbic acid, or its isomer, or the salts thereof, powder capsules of vegetable oils and fats, powder of dried comfrey leaves, and maltose, is not satisfied with the taste of the cigarette when applied with such a moderating agent, and accordingly has made a further study, resulting in the discovery that the presence of wheat protein and soybean protein relax the hazardous taste thereof, reduce the irritation to nil, the presence of natural beefsteak plant moderates the irritancy originally possessed by the cigarette, makes the cigarette more mellow and tasteful, and the presence of Japanese mint, the peppermint, vanilla, etc. give a refershing feel to the smoker, and accents the tastefulness and flavor.

The purpose of the present invention is to provide a moderating agent for cigarette taste which relaxes the cigarette taste to much extent, reduces the irritancy thereof to nil, and makes the cigarette more mellow and tasteful which comprises mixing the ascorbic acid, or its isomer (e.g. eruscorbic acid, etc.), or the slats thereof, with powder capsule of vegetable oils and fats, powder of dried comfrey leaves, at least one substance selected from wheat protein and soybean protein, and beefsteak plant and compounding the resultant mixture with at least one kind of substance selected from Japanese mint, peppermint, and vanilla.

DESCRIPTION OF THE PREFERRED EMBODIMENT

A further detailed description of the composition of the moderating agent for the cigarette taste according to the present invention may show that the ascorbic acid, or its isomer, or the salts thereof are present in the amount of 10–30%; powder capsule of vegetable oils and fats is present in an amount of 30–50%; powder of dried comfrey leaves in the amount of 5–20%; at least one kind of substance selected from wheat protein and soybean protein in an amount of 10–30%; beefsteak plant in an amount of 5–25%, and at least one kind of substance selected from Japanese mint, peppermint (Western mint), and vanilla in an amount of 1–10%. All amounts are in percent by weight.

The description of the action caused by each component may show that ascorbic acid, or its isomer, or the salts thereof modify the cigarette taste by substantially of decreasing the nicotine, tar, and carbon monoxide contained in the smoke drawn into the mouth. When the powder capsule of vegetable oils and fats is broken upon the burning thereof, an oil film is momentarily formed upon the shredded leaf of the cigarette which works as a filter, by which nicotine and tar are absorbed, being resolved by the heat of high temperature. Thus, the capsule thereof gives rise to an action of decreasing the hazardous substance of the cigarette introduced into the mouth.

Next, the powder of dried comfrey leaves causes the action of their chlorophyl the destroy a nicotine smell of the cigarette entering into the mouth, whereby the cigarette taste is moderated. Furthermore, the effect of attaching sufficiently other powder to the top end of the cigarette, which is produced by the action of the cilium provided on the back of the comfrey leaf, is extremly large.

On the other hand, the produces a wide effect of moderating the cigarette taste, and enlargening the action of destroying the nicotine smell in the mouth.

The beefsteak plant, which possesses an aseptic action, attains the stabilization in the quality of the moderating agent of the cigarette taste, if compounded, making the cigarette more mellow and tasteful.

The Japanese mint gives the smoker's mouth a refreshing feel and the peppermint and the vanilla additionally enhanced the flavor of of the cigarette, also making its taste mild.

The embodiments 1–6 are shown in the Table.

Other items which can be present but are not listed in the Table include potassium nitrate, which acts as a combustion improver or a catalyst for the reaction of nicotine-nicotinic acid (vitamin B-complex).

As the powder capsule of vegetable oils and fats, any vegetable oil may be suitable, especially an oil which is comparatively semidry.

List 1

| | Embodiment | | | | | |
|---|---|---|---|---|---|---|
| Composition (%) | 1 | 2 | 3 | 4 | 5 | 6 |
| Ascorbic acid | 15 | 15 | 20 | 20 | 20 | 23 |
| Powder capsule of vegetable oils and fats | 43 | 38 | 33 | 33 | 33 | 30 |
| Powder of dried comfrey leaves | 15 | 10 | 15 | 10 | 10 | 13 |
| Wheat or soybean protein | 10 | 20 | 15 | 15 | 15 | 12 |
| Natural beefsteak plant | 10 | 10 | 11 | 15 | 15 | 15 |
| Natural Japanese mint | 2 | 1 | 1 | 2 | 0 | 2 |
| Natural peppermint | 1 | 2 | 1 | 1 | 3 | 0 |
| Natural vanilla | 2 | 2 | 2 | 2 | 2 | 3 |
| Others | 2 | 2 | 2 | 2 | 2 | 2 |

It is apparent from the foregoing description that the moderating agent of the cigarette taste according to the present invention is characterized by the compounding of over one kind of substance between the wheat and soybean protein and the beefsteak plant, especially the compounding of the beefsteak plant for reducing the irritancy originally possessed by the cigarette as well as enhancing the effect of making the cigarette more mellow and tasteful. Furthermore, since the beefsteak plant possesses an aseptic action, any deterioration in the quality of the moderating agent in creating a good cigarette taste can be prevented.

In addition, since the compounding amount of expensive powder of dried comfrey leaves can be decreased, the formation of the present invention is novel and practical.

What we claim is:

1. A moderating agent for enhancing the taste of tobacco which comprises the composition of a substance selected from the group consisting of ascorbic acid, its isomer and the salts thereof, present in an amount of 10 to 30% by weight, encapsulated powder of vegetable oil or fats, present in an amount of 30 to 50% by weight powder of dried comfrey leaves, present in an amount of 5 to 20% by weight, at least one substance selected from the group consisting of wheat protein and soybean protein, present in an amount of about 10 to 30% by weight, beefsteak plant present in an amount of 5 to 25% by weight, and at least one substance selected from the group consisting of Japanese mint, natural peppermint and vanilla present in an amount of 1 to 10% by weight.

2. A cigarette containing a flavor-enhancing portion attached to one end thereof, said flavor enhancing portion comprising a substance selected from the group consisting of ascorbic acid, it isomer and the salts thereof, present in an amount of 10 to 30% by weight, encapsulating powder of vegetable oil or fats, present in an amount of 30 to 50% by weight, powder of dried comfrey leaves, present in an amount of 5 to 20% by weight, at least one substance selected from the group consisting of wheat protein and soybean protein, present in an amount of about 10 to 30% by weight, beefsteak plant, present in an amount of 5 to 25% by weight, and at least one substance selected from the group consisting of Japanese mint, natural peppermint and vanilla present in an amount of 1 to 10% by weight.

* * * * *